US005928829A

United States Patent [19]

Cheng et al.

[11] Patent Number: 5,928,829

[45] Date of Patent: Jul. 27, 1999

[54] LATEX PROCESSES

[75] Inventors: Chieh-Min Cheng, Rochester; Dwight J. Tshudy, Webster, both of N.Y.

[73] Assignee: Xerox Corporation, Stamford, Conn.

[21] Appl. No.: 09/031,252

[22] Filed: Feb. 26, 1998

[51] Int. Cl.[6] ..... G03G 9/087

[52] U.S. Cl. ..... 430/137; 523/335

[58] Field of Search ..... 430/137; 523/322, 523/335

[56] References Cited

U.S. PATENT DOCUMENTS

| | | | |
|---|---|---|---|
| 3,674,736 | 7/1972 | Lerman et al. | 260/41 R |
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacipante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,364,729 | 11/1994 | Kmiecik-Lawrynowicz et al. | 430/137 |
| 5,370,963 | 12/1994 | Patel et al. | 430/137 |
| 5,403,693 | 4/1995 | Patel et al. | 430/137 |
| 5,418,108 | 5/1995 | Kmiecik-Lawrynowicz et al. | 430/137 |
| 5,561,025 | 10/1996 | Torres et al. | 430/137 |

*Primary Examiner*—John Goodrow
*Attorney, Agent, or Firm*—E. O. Palazzo

[57] ABSTRACT

A process for the preparation of a latex by for example, the polymerization of monomer in the presence of a catalytic chain transfer component, and an initiator.

27 Claims, No Drawings

LATEX PROCESSES

PENDING APPLICATIONS

Processes for the preparation of toners wherein water miscible chain transfer agents are selected are illustrated in copending application Ser. No. 958,397, the disclosure of which is totally incorporated herein by reference.

Emulsion/aggregation toner processes are illustrated in copending applications U.S. Ser. Nos., 959,798, 958,397, and 960,754 the disclosures of each application being totally incorporated herein by reference.

The appropriate components, and processes of the above copending applications, especially the clevable surfactants of U.S. Ser. No. 958,397, may be selected for the present invention in embodiments thereof.

BACKGROUND OF THE INVENTION

The present invention is generally directed to toner processes, and more specifically to processes which utilize aggregation and coalescence or fusion of latex, colorant, such as pigment, dye, or mixtures thereof, and optional additive particles. In embodiments, the present invention is directed to latex emulsion processes and aggregation and coalescence processes with colorant particles, and wherein there is provided substantially sediment free toner compositions with a volume average diameter of for example, from about 1 micron to about 20 microns, and preferably from about 2 micron to about 12 microns and a narrow particle size distribution of, for example, about 1.10 to about 1.45 as measured by the Coulter Counter method, without the need to resort to conventional pulverization and classification methods. The resulting toners can be selected for known electrophotographic imaging and printing processes, including digital color processes, and more specifically these toners are especially useful for imaging processes, especially xerographic processes, which usually require high, about 95 percent or greater, toner transfer efficiency, such as those with a compact machine design without a cleaner or those that are designed to provide high quality colored images with excellent image resolution and acceptable image uniformity.

The present invention in aspects thereof is directed to substantially sediment free processes comprised of blending an aqueous colorant, especially pigment dispersion containing an ionic surfactant with a latex emulsion comprised of polymer particles, and wherein the latex is prepared with catalytic chain transfer agents, or components, such as cobalt complexes. In accordance with the aforementioned processes there is enabled the formation of oligomeric species without the necessity of utilizing high concentrations of chain transfer agent, primarily since the chain transfer catalyst is living, and wherein the process for the generation of the latex ca be by free radical polymerization.

A number of advantages are associated with the processes of the present invention, such as the formation of ultra-low molecular weight latex resins, where the number average molecular weight Mn is for example, from about 1,000 to about 6,000, the weight average molecular weight Mw is for example, from 10,000 to about 40,000, as determined by gel permeation chromatography; the generation of resins with minimal or no odor and wherein the resins are free of solvents like mercaptans; the elimination of post polymerization; avoidance of the need for residual chain transfer agents; and latex stability, and wherein the latex is substantially free of undesirable sediments.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of a polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process can result in the formation of particles with a wide particle size distribution. Similarly, the aforementioned disadvantages, for example poor particle size distributions are obtained hence classification is required resulting in low toner yields, are illustrated in other prior art, such as U.S. Pat. No. 4,797,339, wherein there is disclosed a process for the preparation of toners by resin emulsion polymerization; and U.S. Pat. No. 4,558,108, wherein there is disclosed a process for the preparation of a copolymer of styrene and butadiene by specific suspension polymerization.

In U.S. Pat. No. 5,561,025 there is illustrated emulsion/aggregation/coalescence processes wherein there are selected water phase termination agents, that is chain transfer agents that are not water miscible.

Other prior art that may be of interest includes U.S. Pat. Nos. 3,674,736; 4,137,188 and 5,066,560.

Emulsion/aggregation processes for the preparation of toners with optional charge control additives are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, U.S. Pat. No. 5,346,797. The appropriate components and processes of these patents can be selected for the formation of toner utilizing the latex's generated in accordance with the present invention.

SUMMARY OF THE INVENTION

It is an feature of the present invention to provide toner processes with many of the advantages illustrated herein.

In another feature of the present invention there are provided simple and economical processes for the preparation of latexes, and black and colored toner compositions with excellent colorant, especially pigment dispersions, thus enabling the achievement of excellent color print quality.

In a further feature of the present invention there is provided a process for the preparation of sediment free emulsions and toner compositions thereof with a volume average diameter of from between about 1 to about 20 microns, and preferably from about 2 to about 12 microns, and a particle size distribution of about 1.10 to about 1.35, and preferably from about 1.15 to about 1.25 as measured by a Coulter Counter without the need to resort to conventional classifications to narrow the toner particle size distribution.

In a further feature of the present invention there is provided a process for the preparation of toner by aggregation and coalescence or fusion (aggregation/coalescence) of latex, pigment, and additive particles, and wherein the latex is substantially sediment free and is prepared as illustrated herein.

In yet another feature of the present invention there are provided toner compositions with low fusing temperatures of from about 120° C. to about 180° C., and which toner compositions exhibit excellent blocking characteristics at and above about 45° C.

These and other features of the present invention are accomplished in embodiments by the provision of toners and processes thereof. In embodiments of the present invention, there are provided sediment free, or substantially sediment free processes for the preparation of latexes, and toner compositions thereof by the aggregation/coalescence of latex and colorant, especially pigment particles, and wherein the temperature of the aggregation may be selected to control the aggregate size, and thus the final toner particle size, and the coalescence temperature and time may be utilized to control the toner shape and surface properties.

The present invention relates to a process for the preparation of a latex comprising the polymerization of monomer in the presence of a catalytic chain transfer component, an initiator, and an optional nonionic surfactant; a process wherein the catalytic chain transfer agent is a cobalt complex; a process wherein the cobalt complex is cobalt(II) porphyrin, cobalt (II) dioxime, cobalt (III) dioxime, iridium (II) porphyrin, or rhoium (II) porphyrin; a process wherein the catalytic chain transfer agent is Co(II)(2,3-dioxyiminobutane-$BF_2)_2$; a process wherein the chain transfer agent is selected in an amount of from about 0.001 to about 1 weight percent based on the monomer selected for the preparation of the latex polymer; a process wherein the chain transfer agent is selected in an amount of from about 0.01 to about 0.5 weight percent based on the monomer selected for the preparation of the latex polymer; a process wherein the monomer is selected from the group consisting of alkyl acrylates, alkyl methacrylates, styrenes, acrylonitriles, dienes, vinyl esters, and acid or basic olefinic monomers, wherein said alkyl contains from 1 to about 10 carbon atoms, alkyl acrylates of C1 to C10 carbon atoms; said styrenes are styrene, (α-methyl styrene, and t-butyl styrene; said acrylonitriles are acrylonitrile or methacrylonitrile; the dienes are butadiene or isoprene; the vinyl esters are vinyl acetate or vinyl butyrate; said acid olefinic monomers are acrylic acid, methacrylic acid, fumaric acid, maleic acid, itaconic acid; and the basic olefinic monomers are acrylamide, methacrylamide, vinylpyridine, vinylpyrrolidone, or vinyl-N-methacrylpyridinium; a process wherein there is formed from said monomers polymers of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butyl methacrylate), poly(styrene-butyl acrylate-acrylic acid), poly(styrene-butadiene-acrylic acid), poly (styrene-isoprene-acrylic acid), poly(styrene-butyl methacrylate-acrylic acid), poly(methyl methacrylate-butyl acrylate), poly(butyl methacrylate-butyl acrylate), poly (butyl methacrylate-acrylic acid), poly(styrene-butyl acrylate-acrylonitrile-acrylic acid), poly(methyl methacrylate-butyl acrylate-acrylic acid), or poly (acrylonitrile-butyl acrylate-acrylic acid); a process wherein said monomer is selected in an amount of from about 40 to about 100 percent by weight, and more preferably is from about 70 to about 100 percent of the monomers used to prepare the polymer, or copolymer resin; a process wherein heating is selected to accomplish the polymerization of said monomer; a process wherein heating is selected to accomplish the polymerization of said monomer and wherein said heating is at a temperature of from about 25 to about 120 degrees Centigrade; a process wherein heating is selected to accomplish the polymerization of the monomer and wherein the heating is at a temperature of from about 50 to about 95 degrees Centigrade, and wherein the latex contains substantially no sediment; a process for the preparation of toner comprising (I) aggregating a colorant dispersion with the polymer latex emulsion; (ii) coalescing and fusing the aggregates generated; (iii) isolating, washing, and drying the toner; a process wherein said aggregating is below about the polymer glass transition temperature present in the latex emulsion, the coalescing or fusing of said aggregates is above about the latex polymer glass transition temperature, and there results toner with a size of from about 2 to about 20 microns in volume average diameter; a process wherein the temperature below the glass transition temperature is from about 20° C. to about 60° C., (about includes all the values between those recited throughout) and the heating above the glass transition temperature is from about 60° C. to about 100° C.; a process wherein the temperature below the glass transition temperature is from about 35° C. to about 55° C., and the heating above the glass transition temperature is from about 70° C. to about 95° C.; a process wherein the temperature at which said aggregation is accomplished controls the size of the aggregates, and wherein the final toner size is from about 2 to about 10 microns in average volume diameter, and wherein the temperature and time of said coalescence of the components of aggregates control the shape of the resultant toner; a process wherein the aggregation temperature is from about 45° C. to about 55° C., and wherein the coalescence and fusion temperature is from about 80° C. to 95° C.; a process wherein there is further selected a cosurfactant selected from the group consisting of components of alkanes, hydrocarbyl alcohols, ethers, amines, halides, and esters; a process wherein the colorant is a pigment and wherein the pigment dispersion contains an ionic surfactant; a process wherein the surfactant utilized in the colorant dispersion is a cationic surfactant; a process wherein the aggregation is conducted at a temperature that about 15° C. to about 1° C. below the Tg of the polymer contained in the latex, for a duration of from about 0.5 hour to about 3 hours; a process wherein the coalescence and fusion of the components of aggregates for the formation of integral toner particles comprised of colorant, resin and additives is accomplished at a temperature of about 85° C. to about 105° C. for a duration of from about 1 hour to about 5 hours; a process wherein a monomer selected to generate the latex polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(aryl methacrylate-alkyl acrylate-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), wherein the polymer formed from the monomer is present in an effective amount of from 80 percent by weight to about 98 percent by weight of toner; a process wherein the toner particles isolated are from about 2 to about 10 microns in volume average diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner particles.

Lowmolecular weight polymer latexes, for example wherein the number average molecular weight Mn is from about 1,000 to about 10,000, and preferably is from 1,000 to about 6,000, and the weight average molecular weight Mw is from 5,000 to about 60,000, and preferably is from 10,000 to about 40,000, as determined by gel permeation chromatography, and formed by emulsion polymerization in accordance with the present invention can be generated by free radical polymerization, using a free-radical initiator, in which the molecular weight Mw, and Mn is controlled with for example, the selection of a catalytic amount of a transition metal complex, in suitable concentrations of for example, from about 0.0001 to about 1 percent by weight, and preferably from about 0.001 to about 0.5 percent by weight of monomers used to prepare the polymer, or resin, and in particular a cobalt chelate complex, and which processes can be referred to as catalytic chain transfer polymerizations. Resins with low molecular weights can be selected for toners for high speed printers and copiers. These low molecular weight resins provide excellent fusion and flow characteristics at the temperatures encountered in the copier, printer or digital systems, and they also fuse and melt very quickly after being heated which is of importance in high speed coping and printing operations.

The invention catalytic chain transfer processes avoids the need to use conventional chain transfer agents which often possess disadvantages for example, mercaptans imparts a pronounced odor, while halogenated hydrocarbons, such as bromoform or carbon tetrachloride are environmentally suspect. The use of catalytic chain transfer polymerization to control the molecular weight of monomers, such as vinyl monomers by the addition of catalytic quantities of complexes, such as cobalt complexes in free-radical polymerization methods avoids the need for compounds such as mercaptans, and wherein with such complexes oligomeric species can be generated without the need for large concentrations of chain transfer agent or initiator as the chain transfer catalyst is living (the polymerization is not). Catalytic chain transfer polymerization can result when catalytic quantities for example, in concentrations of from about 1 to about 10,000 ppm by weight, and preferably from about 10 to about 5,000 ppm by weight of monomers used to prepare the polymer resin, of cobalt chain transfer catalysts, like cobalt (II) macrocycles are selected for the free radical polymerization of monomers, such as vinyl monomers. This living free-radical chemistry involves for example, the reversibly interaction of a catalyst segment, such as cobalt (II) reversibly with the polymer chain end and normal polymerization termination reactions are suppressed by the persistent radical effect. Although the exact mechanism of catalytic chain transfer polymerization is not well understood, it is believed to occur via a Co(II)/Co(III) redox couple.

Examples of catalytic chain transfer agents include cobalt (II) porphyrin complexes, cobalt(II) dioxime complexes, cobalt(II) chelate complexes, or cobalt(III) chelate complexes of iridium or rhenium, and the like. Preferred catalytic chain transfer agents for the free radical polymerization are cobalt(II) chelates with bridging groups such as $BF_2$ and optionally coordinated with further ligands such as water, alcohols, ketones, and pyridine, examples of which include cobalt complexes, such as cobalt(II) porphyrin complexes, cobalt (II) dioxime complexes, and the like, and more specifically Co(II)(2,3-dioxyiminobutane-$BF_2)_2$, Co(II)(1,2-diphenyl-1,2-dioxyminoethane-$BF_2)_2$, Co(II)(1,2-dioxyiminocyclohexane-$BF_2)_2$, and 2,12-dimethyl-3,7,11,17-tetraazabicyclo [11.3.1] heptadeca-1(17),2,11,13,15-pentane cobalt(II) bromide monohydrate, and the most preferred is Co(II)(2,3-dioxyiminobutane-$BF_2)_2$. The cobalt catalyst can be employed in various suitable concentrations such as for example, from about 0.0001 to about 1 percent by weight, and preferably from about 0.001 to about 0.5 percent by weight of monomers used to prepare the latex polymer, or copolymer product. However, the optimum concentration is dependent upon the particular monomer or monomers used. For example, 1,1-substituted monomers, such as methyl methacrylate or butyl methacrylate, would normally require less amount of catalyst than 1-substituted monomers, such as methyl acrylate or butyl acrylate. These catalytic chain transfer agents possess for example, a high chain transfer constant often in excess of 10,000, more specifically for example approximately 10,000 times more than most thiols selected for vinyl polymerizations, and yet more specifically from about 800 to about 15,000. Preparation of the catalysts, especially the cobalt chelate catalytic chain transfer agents can be accomplished by known methods, such as those illustrated in H. C. Rai et al., Indian Journal of Chemistry, vol. 18A, 242 (1979), G. N. Schrauzer, Inorg. Syn., 11, 62 (1968), A. Bakac et al., Inorganic Chemistry, 25, 4108 (1986), and D. H. Busch et al., Inorganic Chemistry, 9, 511 (1970), the disclosures of which are totally incorporated herein by reference.

The catalytic chain transfer polymerization can be accomplished either in the absence of a polymerization medium, as a bulk polymerization, or alternatively in a polymerization medium, as a solution, suspension or emulsion polymerization. In emulsion polymerization, the suitable medium is water, for example, from about 50 to about 95 percent by weight, and preferably from about 60 to about 80 percent by weight water based on the components in the reaction mixture for the emulsion polymerization, in combination with any conventional emulsifying agent or agents. Emulsifying agents can be anionic such as sodium dodecyl sulfate, sodium dodecyl naphthalene sulfate, sodium dodecylbenzene sulfonate, disodium dodecyl disulfonate, sodium dioctyl sulfosuccinate, and the like, or cationic components such as hexadecyl trimethyl ammonium bromide, dodecyl trimethyl ammonium bromide, dodecylbenzyl triethyl ammonium chloride, lauryl trimethyl ammonium chloride, or cetyl pyridinium bromide, or nonionic such as alcohol ethoxlates, alkylphenol ethoxylates, or polyalkylene glycol ethers. An effective concentration of the emulsifying agent generally employed is, for example, from about 0.01 to about 10 percent by weight, and preferably from 0.1 to about 5 percent by weight of monomers selected for the to preparation of the polymer latex product.

The emulsion polymerization process may be accomplished by a batch process (a process in which all the components to be employed are present in the polymerization medium at the start of the polymerization) or a semi-continuous process in which monomer or monomers 100 percent by weight, and preferably from about 75 to about 100 percent by weight of monomers used to prepare the copolymer resin is fed to the polymerization medium during the polymerization. The monomer(s) can be fed neat or as emulsions in water.

Emulsion polymerization with the catalytic chain transfer agent or agents are usually performed by heating, for example, at a temperature of from about 25 to about 120° C., and preferably from about 50 to about 95° C. and wherein for the reaction there is included initiators, such as azo polymerization initiators, with a solubility of greater than about, or about equal to 0.05 grams, and preferably about 0.5 grams per liter of monomers at 25° C. in the monomer mixture, or water, and with an appropriate half life at the temperature of polymerization. Appropriate half life refers for example, to a half life of about 1 to 4 hours. Typical examples of such initiators, are azocumene, 2,2'-azobis (isobutyronitrile), 2,2'-azobis(2-methyl)butanenitrile, 4,4'-azobis(4-cyanovaleric acid), 2,2'-azobis[2-methyl-N-(2-hydroxyethyl)]-propionamide, 2,2'-azobis[2-methyl-N-1,1-bis(hydroxymethyl)-2-(hydroxyethyl)]-propionamide, and 2-(t-butylazo)-2-cyanopropane. Other soluble non-azo initiators with an appropriate half life may also be used, including, among others, benzoyl peroxide, lauroyl peroxide, molecular hydrogen, and sodium, potassium or ammonium persulfates. An effective concentration of the initiator generally employed is, for example, from about 0.05 to about 10 percent by weight, and preferably from about 0.2 to about 5 percent by weight of monomers used to prepare the polymer, or copolymer resin. Redox initiator systems can also be used, such as redox pairs like ammonium persulphate/sodium metabisulphite. An effective concentration of the redox initiator generally employed is, for example, from about 0.01 to about 10 percent by weight, and preferably from about 0.05 to about 3 percent by weight of monomers in the reaction mixture.

To ensure maximum catalyst activity the emulsion polymerizations should preferably be accomplished in the substantial absence of oxygen under an inert atmosphere, such as nitrogen, argon or other non-oxidizing gas.

The present invention is directed to processes for the preparation of toner compositions which comprises blending an aqueous colorant dispersion preferably containing a pigment such as carbon black, phthalocyanine, cyan, magenta, yellow, red, blue, green, and more specifically quinacridone or RHODAMINE B™ type with a cationic surfactant, such as benzalkonium chloride, with a latex emulsion prepared as illustrated herein and which latex is sediment free, and wherein the latex monomers are selected for example, from the group consisting of styrene, butadiene, acrylates, methacrylates, acrylonitrile, acrylic acid, methacrylic acid, and the like; heating the resulting flocculent mixture at a temperature below or about equal to the Tg of the polymer or resin formed in the latex, ranging for example, from about 30° C. to about 55° C. for an effective length of time of for example 0.5 hour to about 2 hours to form toner sized aggregates; and subsequently heating the aggregates, preferably suspension at a temperature at or above the Tg of the latex polymer, for example from about 60 to about 100° C. to provide toner particles; and cooling, isolating the toner product by filtration, and thereafter washing and drying in an oven, fluid bed dryer, freeze dryer, or spray dryer; whereby toner particles comprised of polymer, or resin, colorant, and optional additives are obtained; processes for the preparation of polymer containing latex's and which latex's can be selected for emulsion/aggregation/coalescence processes illustrated in the appropriate patents recited herein, wherein the emulsion process utilizes a catalytic chain transfer agent, and there is enabled sediment, or substantially sediment free latex's, and there is formed a polymer latex wherein the polymer is of a low molecular weight, for example where the number average molecular weight Mn is from about 1,000 to about 10,000, and preferably is from 1,000 to about 6,000, the weight average molecular weight Mw is from 5,000 to about 60,000, and preferably is from 10,000 to about 40,000, and wherein chain transfer agents such as carbon tetrabromide, mercaptans, and the like are avoided; a direct toner preparative process comprised of blending an aqueous colorant dispersion containing for example a pigment, such as magenta, yellow, cyan, red, green, and more specifically HELIOGEN BLUE™ or HOSTAPERM PINK™, and a cationic surfactant such as benzalkonium chloride (SANIZOL B-50™), and a latex emulsion generated with a catalytic chain transfer agent, and wherein the latex polymer is derived from emulsion polymerization of monomers selected for example, from the group consisting of styrene, acrylates, methacrylates, acrylonitrile, butadiene, acrylic acid, methacrylic acid, and the like, thereby resulting in the flocculation of the polymer particles with the pigment particles and optional additives; and which flocculent mixture, on further stirring at a temperature of from about 35° C. to about 60° C., results in the formation of toner sized aggregates having an aggregate size of from about 2 microns to about 20 microns in volume average diameter as measured by the Coulter Counter (Microsizer II) and a particle size distribution of about 1.15 to about 1.35; thereafter, heating the aggregate suspension at from about 70° C. to about 95° C. to form toner particles; followed by cooling, and isolation by known methods, such as filtration, washing, and drying in an oven, or the like; a process for the preparation of toner comprised of polymer and colorant, especially pigment comprising (i) blending an aqueous colorant dispersion containing an ionic surfactant with an emulsion latex containing resin generated as indicated herein and in the presence of a catalytic chain transfer agent preferably of for example bis(2,3-dioxyiminobutane) tetraflurodiborato cobalt [Co(II)(2,3-dioxyiminobutane-$BF_2$)$_2$], bis(1,2-diphenyl-1,2-dioxyminoethane) tetraflurodiborato cobalt [Co(II)(1,2-diphenyl-1,2-dioxyminoethane-$BF_2$)$_2$], or bis(1,2-dioxyiminocyclohexane) tetraflurodiborato cobalt [Co(II)(1,2-dioxyiminocyclohexane-$BF_2$)$_2$], and wherein these catalytic chain transfer agents are preferably utilized in concentrations, or amounts of from about 0.0001 to about 1 percent by weight, and preferably from about 0.001 to about 0.5 percent by weight of monomers used to prepare the polymer inclusive of copolymers, and a surfactant with a charge polarity opposite to that of ionic surfactant in the colorant dispersion;

(ii) heating the resulting mixture at a temperature of about 25° C. to about 1° C. below the Tg (glass transition temperature)of the latex resin, or polymer to form toner sized aggregates;

(iii) subsequently heating the resulting aggregate suspension to a temperature of about 75° C. to about 120° C. to effect coalescence or fusion of the components of aggregates to enable formation of integral toner particles comprised of polymer, and colorant; and (iv) isolating the toner product by for example filtration, followed by washing and drying; processes for the preparation of toner compositions which comprise (i) preparing an ionic colorant mixture by dispersing a colorant, especially pigment such as carbon black, HOSTAPERM PINK™, or PV FAST BLUE™ and the like, in an aqueous surfactant solution containing a cationic surfactant such as dialkylbenzene dialkylammonium chloride like SANIZOL B-50™ available from Kao or MIRAPOL™ available from Alkaril Chemicals by means of a high shearing device such as a Brinkmann Polytron or IKA homogenizer; (ii) adding the aforementioned colorant, especially pigment mixture to a mixture of a water optional additives, and a latex emulsion prepared as illustrated herein and comprised of polymer particles of for example, poly (styrene-butyl acrylate-acrylic acid), poly(styrene-butadiene-acrylic acid), and the like, and a nonionic surfactant such as polyethylene glycol or polyoxyethylene glycol nonyl phenyl ether or IGEPAL 897™ obtained from GAF Chemical Company, and an optional cosurfactant, thereby causing a flocculation of colorant, and polymer particles; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 micron to about 20 microns in volume average diameter; (iv) and heating the mixture in the presence of additional anionic surfactant or nonionic surfactant at a temperature of about 120° C. or above the latex polymer Tg temperature for a duration of for example, from about 1 to about 5 hours to form 2 to about 12 micron toner preferably with a particle size distribution of from about 1.15 to about 1.35 as measured by the Coulter Counter; and (v) isolating the toner particles by filtration, washing, and drying. Additives to improve flow characteristics and charge additives, if not initially present, to improve charging characteristics may then be added by blending with the formed toner, such additives including AEROSILS® or silicas, metal oxides like tin, titanium and the like, metal salts of fatty acids, like zinc stearate, and which additives are each present in various effective amounts, such as from about 0.1 to about 10 percent by weight of the toner.

Illustrative examples of specific latex monomers, in suitable amounts, for example, from about 40 to about 100 percent by weight, and more preferably is from about 60 to about 100 percent, or parts are alkyl acrylates, alkyl methacrylates, styrenes, acrylonitriles, dienes, vinyl esters, and acid or basic olefinic monomers, and generally acrylates, methacrylates, especially styrene acrylates, and styrene methacrylates. Examples of alkyl acrylates are C1 to C10 alkyl acrylates; of alkyl methacrylates are C1 to C10 alkyl methacrylates; of styrenes are styrene, a-methyl styrene, and t-butyl styrene; of acrylonitriles are acrylonitrile or methacrylonitrile; of dienes are butadiene or isoprene; of vinyl esters are vinyl acetate or vinyl butyrate; of acid olefinic monomers are acrylic acid, methacrylic acid, fumaric acid, maleic acid, itaconic acid; and of basic olefinic monomers are acrylamide, methacrylamide, vinylpyridine, vinylpyrrolidone, or vinyl-N-methacrylpyridinium. Polymers generated from the monomers selected include poly (styrene-methyl methacrylate), poly(styrene-butyl methacrylate), poly(styrene-butyl acrylate), poly(styrene-butadiene), poly(methyl methacrylate-butyl acrylate), poly (butyl methacrylate-butyl acrylate), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-acrylic acid), poly(styrene-butyl acrylate-acrylonitrile-acrylic acid), poly(methyl methacrylate-butyl acrylate-acrylic acid), poly (acrylonitrile-butyl acrylate-acrylic acid), and the like. With the processes of the present invention monomers as illustrated herein are selected and preferably monomers of methyl methacylate, ethyl methacrylate, n-butyl methacrylate, styrene, and a-methyl styrene. Polymers generated from the monomers selected include poly(styrene-butyl methacrylate), poly(styrene-butyl acrylate), poly (methyl methacrylate-butyl acrylate), poly(methyl methacrylate-butyl acrylate-acrylic acid), and poly(styrene-butyl acrylate-acrylic acid). The latex polymer is generally present in the toner compositions in various suitable amounts, such as from about 75 weight percent to about 98 weight percent of the toner and the latex resin size suitable for the processes of the present invention can be for example, from about 0.05 micron to about 1 micron in volume average diameter as measured by the Brookhaven nanosize particle analyzer.

Various known colorants, such as pigments present in the toner in an effective amount of, for example, from about 1 to about 20 percent by weight of toner, and preferably in an amount of from about 3 to about 12 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104198; and the like, and wherein the magnetites, especially when present as the only colorant component can be selected in an amount of up to about 70 weight percent. As colorants there can be selected cyan, magenta, yellow, red, green, brown, blue or mixtures thereof. Specific examples of colorants include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy- 4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Colorants, include pigment, dye, mixtures of pigment and dyes, mixtures of pigments, mixtures of dyes, and the like.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in effective amounts of, for example, 0.01 to about 10 weight percent of the reaction mixture in embodiments include, for example, nonionic surfactants, and which nonionic surfactants are contained in the latex emulsion during emulsion polymerization, examples of which are surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™; anionic surfactants such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, Biosoft D-40™ obtained from Stepan, and the like, in effective amounts of for example, from about 0.01 to about 10 percent by weight. Examples of the colornat dispersion cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of for example from about 0.01 percent to about 10 percent by weight. Preferably, the molar ratio of the cationic surfactant used for flocculation to the anionic surfactant used in the latex preparation is in the range of from about 0.5 to about 4.

Examples of surfactants which can be added to the aggregates before coalescence is initiated are anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, Biosoft D-40™ obtained from Stepan, and the like; nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to primarily stabilize the aggregate size from further growth, or to minimize growth, with temperature is, for example, from about 0.01 to about 10 percent by weight, and preferably from about 0.5 to about 5 percent by weight of the reaction mixture.

Surface additives that can be added to the toner compositions preferably after washing or drying include as indicated herein, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, silicas and coated silicas, like AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 5,002,846, 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,265,660, 4,585,884, 4,584,253, and 4,563,408, the disclosures of which are totally incorporated herein by reference.

The following Examples are being submitted to further define various pieces of the present invention. These Examples are intended to be illustrative only and are not intended to limit the scope of the present invention.

EXAMPLE I

Synthesis of Catalytic Chain Transfer Agent Co(II) (2,3-dioxyiminobutane-$BF_2$)$_2$ Co(II)(2,3-dioxyiminobutane-$BF_2$)$_2$ was prepared according to the procedure of A. Babac et al., *Inorganic Chemistry,* 25, 4108 (1986), the disclosure of which is totally incorporated herein by reference. In a 500 ml glass flask, a suspension of cobalt acetate (4 grams) and dimethylglyoxime (3.8 grams) in 300 ml of oxygen-free diethyl ether was treated with freshly distilled boron trifluoride diethyl etherate (20 ml). The mixture was stirred at room temperature, about 25 degrees Centigrade for 5.5 hours, during which time the product with a brown color precipitated. The brown solid obtained by filtration was washed 3 times with 500 ml of ice-cold water and air-dried. The yield was about 4 grams.

EXAMPLE II

A latex emulsion comprised of polymer particles derived from, or generated from the emulsion polymerization of styrene, butyl acrylate and acrylic acid was prepared as follows. Co(II)(2,3-dioxyiminobutane-$BF_2$)$_2$ obtained from Example 1 was used as a chain transfer agent in an amount of 0.2 wt % (weight percent) based on the amount of total monomers used to prepare the copolymer resin (0.2 pph or 2,000 ppm of monomers). 432 grams of styrene, 108 grams of butyl acrylate, 16.2 grams of acrylic acid, 13 grams of 4,4'-azobis(4-cyanovaleric acid) initiator (75% active), and 1.0 grams of Co(II)(2,3-dioxyiminobutane-$BF_2)_2$ as the catalytic chain transfer agent were mixed with 810 grams of deinoized water in which 16.5 grams of sodium dodecyl benzene sulfonate anionic surfactant, Biosoft D-40™ (38% active) was dissolved. The resulting mixture was stirred at room temperature of about 25 degrees Centigrade (°C.) under a nitrogen atmosphere for 60 minutes. Subsequently, the resulting mixture was stirred and heated to 80° C. (Centigrade throughout) at a rate of 1° C. per minute, and retained at this temperature for 6 hours. A nitrogen atmosphere was maintained in the flask throughout the course of the reaction. The resulting latex contained 60 percent of water and 40 percent of solids of the styrene-butyl acrylate-acrylic acid polymer 80/20/3 parts (by weight). The resulting latex polymer possessed a Mw of 21,500, a Mn of 6,000 as determined on a Waters GPC, and a mid-point Tg of 62.4° C. as measured on a Seiko DSC. The latex polymer, or latex resin possessed an average volume diameter of 190 nanometers as measured by light scattering technique on a Coulter N4 Plus Particle Sizer.

No sediment was observed after the latex was allowed to stand for two weeks. The amount of sediment determined via a IEC Centrifuge at 3120 G-force for 50 seconds was less than 0.5 weight percent of the latex after two weeks. 260.0 grams of the above prepared latex emulsion and 220.0 grams of an aqueous cyan pigment dispersion containing 7.6 grams of Cyan Pigment 15.3, and 2.6 grams of cationic surfactant, Sanizol B-50™ were simultaneously added to 400 ml of water with high stirring at 6,000 rpm for 3 minutes by means of a polytron. The resulting mixture was then transferred to a 2-liter reaction vessel and heated at a temperature of 54° C. for 2.0 hours before 25 ml of 20% aqueous Biosoft D-40™ solution was added. Aggregates with a particle size (volume average diameter) of about 6.9 microns with a GSD=1.17, as measured on the Coulter Counter, were obtained. Subsequently, the mixture was heated to 93° C. and held there for a period of 3 hours before cooling down to room temperature, about 25 degrees Centigrade throughout, filtered, washed with 2 liters of water six times, and dried in a freeze dryer. The final toner product evidenced a particle size of 7.6 micron in volume average diameter with a particle size distribution of 1.18 as measured on a Coulter Counter.

The resulting toner, that is the above final toner product was comprised of about 93 percent of polymer, poly (styrene-butyl acrylate-acrylic acid), and 15:cyan pigment, about 7 percent by weight of toner, with an average volume diameter of 7.6 microns and a GSD of 1.18, indicating that one can retain particle size and GSD achieved in the aggregation step during coalescence, without the aggregates falling apart and without an excessive increase in particle size, when a latex with desirable low molecular weight to was generated by using low amounts of Co(II)(2,3-dioxyiminobutane-$BF_2)_2$ as a catalytic chain transfer agent in free radical emulsion polymerization. The resulting E/A toner particles which possess no undesirable odor or residual halogenated compounds, did not require a post-polymerization treatment for elimination of any residual chain transfer agent.

EXAMPLE III

A latex emulsion comprised of polymer particles derived from, or generated from the emulsion polymerization of styrene, butyl acrylate and acrylic acid was prepared as follows. Co(II)(2,3-dioxyiminobutane-$BF_2)_2$ was used as a chain transfer agent; the amount selected was 0.2 wt % based on the amount of total monomers used to prepare the copolymer resin (0.2 pph or 2,000 ppm of monomers). 432 grams of methyl methacrylate, 108 grams of butyl acrylate, 16.2 grams of acrylic acid, 8.1 grams of ammonium persulfate initiator, and 1.0 grams of Co(II)(2,3-dioxyiminobutane-$BF_2)_2$ as the catalytic chain transfer agent were mixed with 810 grams of deinoized water in which 31.4 grams of sodium dodecyl benzene sulfonate anionic surfactant, Neogen R™ (20% active) was dissolved. The resulting mixture was stirred at room temperature of about 25 degrees Centigrade (°C.) under a nitrogen atmosphere for 60 minutes. Subsequently, the resulting mixture was stirred and heated to 70° C. (Centigrade throughout) at a rate of 1° C. per minute, and retained at this temperature for 6 hours. A nitrogen atmosphere was maintained in the flask throughout the course of the reaction. The resulting latex contained 60 percent of water and 40 percent of solids of the methyl methacrylate-butyl acrylate-acrylic acid polymer 80/20/3 parts (by weight). The resulting latex polymer possessed a Mw of 32,000, a Mn of 6,000 as determined on a Waters GPC, and a mid-point Tg of 58.4° C. as measured on a Seiko DSC. The latex polymer, or latex resin possessed an average volume diameter for the polymer of 176 nanometers as measured by light scattering technique on a Coulter N4 Plus Particle Sizer.

No sediment was observed after the latex was allowed to stand for two weeks. The amount of sediment determined via a IEC Centrifuge at 3120 G-force for 50 seconds was less than 0.5 weight percent of the latex after two weeks.

260.0 grams of the above prepared latex emulsion and 220.0 grams of an aqueous cyan pigment dispersion containing 7.6 grams of Cyan Pigment 15.3, and 2.6 grams of cationic surfactant, Sanizol B-50™ were simultaneously added to 400 ml of water with high stirring at 6,000 rpm for 3 minutes by means of a polytron. The resulting mixture was then transferred to a 2-liter reaction vessel and heated at a temperature of 54° C. for 2.0 hours before 25 ml of 20% aqueous Biosoft D-40™ solution was added. Aggregates with a particle size (volume average diameter) of about 6.6 microns with a GSD=1.18, as measured on the Coulter Counter, were obtained. Subsequently, the mixture was heated to 93° C. and held there for a period of 3 hours before cooling down to room temperature, about 25 degrees Centigrade throughout, filtered, washed with 2 liters of water, six repeated washings, and dried in a freeze dryer. The final toner product evidenced a particle size of 7.2 micron in volume average diameter with a particle size distribution of 1.21 as measured on a Coulter Counter.

The resulting toner, that is the above final toner product was comprised of about 93 percent of polymer, poly (styrene-butyl acrylate-acrylic acid), and 15:cyan pigment, about 7 percent by weight of toner, with an average volume diameter of 7.2 microns and a GSD of 1.21, indicating that one can retain particle size and GSD achieved in the aggregation step during coalescence, without the aggregates falling apart and without an excessive increase in particle size, when the latex resin was prepared with Co(II)(2,3-dioxyiminobutane-$BF_2)_2$ as a catalytic chain transfer agent. The resulting toner particles possessed no undesirable odor or residual halogenated compounds.

EXAMPLE IV

A latex was prepared by semi-continuous emulsion polymerization of styrene/butyl acrylate/acrylic acid, 75/25/3 parts (by weight), using Co(II)(2,3-dioxyiminobutane-$BF_2)_2$ as a chain transfer agent as follows. The amount of Co(II)(2,3-dioxyiminobutane-$BF_2)_2$ used was 0.1 wt % based on the amount of total monomers used to prepare the copolymer resin (0.1 pph or 1,000 ppm of monomers). In a 2 L jacketed glass flask with a stirrer set at 200 rpm, 31.1 grams of sodium dodecyl benzene sulfonate anionic surfactant, Neogen R™ (20% active), 8.1 grams of ammonium persulfate initiator, and 770 grams of deionized water were purged with nitrogen for 30 minutes while the temperature was increased from about 25° C. to 80° C. A monomer mixture was prepared from 405 grams of styrene, 135 grams of n-butyl acrylate, 16.2 grams of acrylic acid, and 6.5 grams of Co(II)(2,3-dioxyiminobutane-$BF_2)_2$ as the catalytic chain transfer agent. Twenty-eight (28) grams of seed was removed from the monomer mixture and added into the flask and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 535 grams of monomer mixture was fed continuously into the reactor over 3 hours and 55 minutes. A nitrogen atmosphere was maintained in the flask throughout the course of the reaction. The nitrogen purge was reduced to a slow trickle to maintain a small positive pressure. After the above monomer addition was completed, the reaction was allowed to post react for 90 minutes at 80° C. The resulting latex contained 60 percent of water and 40 percent of solids of the styrene-butyl acrylate-acrylic acid polymer 75/25/3 parts (by weight). The resulting latex polymer possessed a Mw of 23,800, a Mn of 6,600, as determined on a Waters GPC, and a mid-point Tg of 56.9° C., as measured on a Seiko DSC. The latex resin possessed an average volume diameter of 153 nanometers as measured by light scattering technique on a Coulter N4 Plus Particle Sizer.

No sediment was observed after the latex was to allowed stand for two weeks. The amount of sediment determined via a IEC Centrifuge at 3120 G-force for 50 seconds was less than 0.1 weight percent of the latex after two weeks.

260.0 grams of the above prepared latex emulsion and 220.0 grams of an aqueous cyan pigment dispersion containing 7.6 grams of Cyan Pigment 15.3, and 2.3 grams of cationic surfactant, Sanizol B-50™ were simultaneously added to 400 ml of water with high shear stirring at 7,000 rpm for 3 minutes by means of a polytron. The resulting mixture was then transferred to a 2-liter reaction vessel and heated at a temperature of 53° C. for 1.5 hours before 30 ml of 20% aqueous Biosoft D-40™ solution was added. Aggregates with a particle size (average volume diameter) of 6.6 microns with a GSD=1.19, as measured on the Coulter Counter, were obtained. Subsequently, the mixture was heated to 93° C. and held there for a period of 2.5 hours before cooling down to room temperature, about 25 degrees Centigrade throughout, filtered, washed with water, and dried in a freeze dryer. The final toner product evidenced a particle size of 7.1 micron in volume average diameter with a particle size distribution of 1.19 as measured on a Coulter Counter.

The resulting toner, that is the above final toner product was comprised of about 93 percent of polymer, poly (styrene-butyl acrylate-acrylic acid), and 15:cyan pigment, about 7 percent by weight of toner, with an average volume diameter of 7.1 microns and a GSD of 1.19, indicating that the particle size and GSD achieved in the aggregation step during coalescence can be retained, without the aggregates falling apart and without an excessive increase in particle size. The resulting toner particles possessed no undesirable odor or residual halogenated compounds, thus a post-polymerization treatment or elimination of the residual transfer agent was not required.

COMPARATIVE EXAMPLE IA

A latex emulsion comprised of polymer particles derived from emulsion polymerization of styrene, butyl acrylate and acrylic acid was prepared as follows. 432 grams of styrene, 108 grams of butyl acrylate, 16.2 grams of acrylic acid, 16.2 grams of the chain transfer agent 1-dodecanethiol (3.0 wt % based total monomers, or 3 pph or 30,000 ppm of monomers), and 5.4 grams of chain transfer agent carbon tetrabromide (1.0 wt % based on the amount of total monomers used to prepare the copolymer resin, or 1 pph or 10,000 ppm of monomers) were mixed with 810 grams of deinoized water in which 19.2 grams of sodium dodecyl benzene sulfonate anionic surfactant, Neogen R™ (20% active), and 5.4 grams of ammonium persulfate initiator were dissolved. No reactive surfactants were added for the purpose of for example, enhancing the latex stability during emulsion polymerization. No catalytic chain transfer agents were added for the purpose of for example, enhancing the latex stability during emulsion polymerization and generating low molecular weight resins with minimal or no odor. Subsequently, the mixture was stirred and heated to 70° C. (Centigrade throughout) at a rate of 1° C. per minute, and retained at this temperature for 6 hours. The resulting latex contained 60 percent of water and 40 percent of solids of the styrene-butyl acrylate-acrylic acid polymer 80/20/3 parts (by weight). The resulting latex polymer possessed an Mw of 22,300, an Mn of 5,400, as determined on a Waters GPC, and a mid-point Tg of 58.9° C., as measured on a Seiko DSC. The latex showed an average volume diameter for the polymer of 178 nanometers as measured by light scattering technique on a Coulter N4 Plus Particle Sizer.

Sediment containing low Mw and low Tg polymer particles was observed after the latex was allowed to stand for two days. The amount of sediment determined via a IEC Centrifuge at 3120 G-force for 50 seconds was about 4.5 weight percent of the prepared latex, which contained undesirable polymer particles with a low Mw=19,100 and a low glass transition temperature of 33° C. This undesirable portion, which is about 4.5 weight percent of the latex, can be removed from the remainder of the latex by a known sedimentation techniques. The amount of this undesirable latex sediment can be reduced from about 4.5 percent to about less than about 0.5 percent by weight of the latex by an emulsion polymerization process utilizing a reactive surfactant. A sediment is a latex containing undesirable polymer particles which possess a large particle size, low molecular weight and low Tg. An emulsion product containing some sediment is not as suitable both for the aggregation/coalescence processes and for generating toner compositions. A sediment can cause the aggregates to have a greater propensity to fall apart or can result in an excessive increase in particle size, as evidenced by the final toner particle size and GSD. Therefore, the sediment is usually removed prior to the aggregation/coalescence to retain toner particle size with a narrow GSD. Sediment generated during the emulsion polymerization will also result in loss of material, lower production yield, waste disposal, and a need for additional capital investment for sediment removal equipment such as a centrifuge.

In this Comparative Example, the undesirable polymer particles were not removed in order to be able to better compare the results of this Comparative Example with Examples II to VI. 260.0 grams of the above prepared latex emulsion and 220.0 grams of an aqueous cyan pigment dispersion containing 7.6 grams of Cyan Pigment 15.3, and 2.3 grams of cationic surfactant, Sanizol B-50™ were simultaneously added to 400 ml of water with high shear stirring at 7,000 rpm for 3 minutes by means of a polytron. The resulting mixture was then transferred to a 2-liter reaction vessel and heated at a temperature of 53° C. for 2.5 hours before 40 ml of 20% aqueous Neogen RI™ solution was added. Aggregates with a particle size (average volume diameter) of 6.7 microns with a GSD=1.21, as measured on the Coulter Counter, were obtained. Subsequently, the mixture was heated to 90° C. and held there for a period of 3 hours before cooling down to room temperature, about 25 degrees Centigrade throughout, filtered, washed with water, and dried in a freeze dryer. The final toner product evidenced a particle size of 7.9 micron in volume average diameter with a particle size distribution of 1.37 as measured on a Coulter Counter.

The results in Examples II to VI indicate that the use of a catalytic chain transfer agent formed polymers where the number average molecular weight Mn is for example, from about 1,000 to about 6,000, the weight average molecular weight Mw is from 5,000 to about 40,000; generated resins with minimal or no odor and wherein the resins are free of solvents like mercaptans; eliminated the need for residual chain transfer agent like halogenated hydrocarbons; and enhanced the latex stability observed during emulsion polymerization and minimizes/eliminates the amount of sediment, that is the undesirable polymer particles, prepared during emulsion polymerization. Sediment in an emulsion causes the aggregates to fall apart or grow substantially, as demonstrated by this Comparative Example. As demonstrated by the above Examples II to VI, the use of the emulsion polymerization with a reactive surfactant can increase the latex stability and can yield latexes with excellent characteristics with respect to their use in toner aggregation processes.

An advantage of using catalytic chain transfer agents is that a low molecular weight polymer latex can be generated with small amounts, for examples about 0.5% of monomers, of chain transfer agent, and the process is sediment free, or substantially sediment free. The agent is odorless as compared with mercaptans. With mercaptans the amount needed generally is high (greater than 3% of monomers), and the polymer latex or polymer resin possesses undesirable odor, which usually needs to be stripped out by post treatment process such as treated with $H_2O_2$. If the organohalogenated compounds such as carbon tetrabromide, carbon tetrachloride, bromoform, or bromotrichloromethane are used, the amount of chain transfer agent needed for generating low molecular weight emulsion/aggregation toner resins are high (greater than for example, 3% of monomers), while the residual amount are relatively high after polymerization (of 1,000 to 10,000 ppm based on copolymer resin). Again, a post treatment was needed to reduce the residual chain transfer agent content.

Other modifications of the present invention may occur to those skilled in the art subsequent to a review of the present application. The aforementioned modifications, including equivalents thereof, are intended to be included within the scope of the present invention.

What is claimed is:

1. A process for the preparation of a latex comprising the polymerization of monomer in the presence of a catalytic chain transfer component, and an initiator.

2. A process in accordance with claim 1 wherein the catalytic chain transfer agent is a cobalt complex.

3. A process in accordance with claim 1 wherein the chain transfer component is cobalt(II) porphyrin, cobalt (II) dioxime, cobalt (III) dioxime, iridium (II) porphyrin, or rhoium (II) porphyrin.

4. A process in accordance with claim 2 wherein the catalytic chain transfer agent is Co(II)(2,3-dioxyiminobutane-$BF_2$)$_2$.

5. A process in accordance with claim 1 wherein the chain transfer agent is selected in an amount of from about 0.001 to about 1 weight percent based on the amount of monomer selected for the preparation of the latex polymer.

6. A process in accordance with claim 1 wherein the chain transfer agent is selected in an amount of from about 0.01 to about 0.5 weight percent.

7. A process in accordance with claim 1 wherein the monomer is selected from the group consisting of alkyl acrylates, alkyl methacrylates, styrenes, acrylonitriles, dienes, vinyl esters, acid olefinic monomers, and basic olefinic monomers, wherein said alkyl contains from 1 to about 10 carbon atoms, alkyl acrylates of about C1 to about C10 carbon atoms; said styrenes are styrene, α-methyl styrene, and t-butyl styrene; said acrylonitriles are acrylonitrile or methacrylonitrile; said dienes are butadiene or isoprene; said vinyl esters are vinyl acetate or vinyl butyrate; said acid olefinic monomers are acrylic acid, methacrylic acid, fumaric acid, maleic acid, or itaconic acid; and said basic olefinic monomers are acrylamide, methacrylamide, vinylpyridine, vinylpyrrolidone, or vinyl-N-methacrylpyridinium.

8. A process in accordance with claim 1 wherein there is formed from the polymerization of monomer, polymers of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butyl methacrylate), poly(styrene-butyl acrylate-acrylic acid), poly(styrene-butadiene-acrylic acid), poly (styrene-isoprene-acrylic acid), poly(styrene-butyl methacrylate-acrylic acid), poly(methyl methacrylate-butyl acrylate), poly(butyl methacrylate-butyl acrylate), poly (butyl methacrylate-acrylic acid), poly(styrene-butyl acrylate-acrylonitrile-acrylic acid), poly(methyl methacrylate-butyl acrylate-acrylic acid), or poly (acrylonitrile-butyl acrylate-acrylic acid).

9. A process in accordance with claim 1 wherein said monomer is selected in an amount of from about 40 to about 100 percent by weight, or from about 70 to about 100 percent of the monomers used to prepare the latex polymer.

10. A process in accordance with claim 1 wherein heating is selected to accomplish the polymerization of said monomer.

11. A process in accordance with claim 1 wherein heating is selected to accomplish the polymerization of said monomer and wherein said heating is at a temperature of from about 50 to about 95 degrees Centigrade, and wherein the latex contains substantially no sediment.

12. A process for the preparation of toner comprising (i) aggregating a colorant dispersion with the polymer latex emulsion of claim 1;

(ii) coalescing and fusing the aggregates generated; and (iii) isolating, washing, and drying the toner.

13. A process in accordance with claim 12 wherein said aggregating is below about the polymer glass transition temperature present in the latex emulsion, the coalescing and fusing of said aggregates is above about the latex polymer glass transition temperature, and there results toner with a size of from about 2 to about 20 microns in volume average diameter.

14. A process in accordance with claim 13 wherein said temperature below the glass transition temperature is from about 25° C. to about 60° C., and the heating above the glass transition temperature is from about 60° C. to about 100° C.

15. A process in accordance with claim 13 wherein said temperature below the glass transition temperature is from about 35° C. to about 55° C., and the heating above the glass transition temperature is from about 70° C. to about 95° C.

16. A process in accordance with claim 12 wherein the temperature at which said aggregation is accomplished controls the size of the aggregates, and wherein the final toner size is from about 2 to about 12 microns in average volume diameter, and wherein the temperature and time of said coalescence of the components of aggregates control the shape of the resultant toner.

17. A process in accordance with claim 13 wherein the aggregation temperature of is from about 45° C. to about 55° C., and wherein the coalescing temperature is from about 80° C. to 95° C.

18. A process in accordance with claim 12 wherein there is further selected a cosurfactant selected from the group consisting of components of alkanes, hydrocarbyl alcohols, ethers, amines, halides, and esters.

19. A process in accordance with claim 12 wherein the colorant is a pigment and wherein said pigment dispersion contains an ionic surfactant.

20. A process in accordance with claim 19 wherein the surfactant utilized in the colorant dispersion is a cationic surfactant.

21. A process in accordance with claim 12 wherein the aggregating is conducted at a temperature that about 15° C. to about 1° C. below the Tg of the polymer contained in the latex, for a duration of from about 0.5 hour to about 3 hours.

22. A process in accordance with claim 12 wherein the coalescing of the components of aggregates for the formation of integral toner particles comprised of colorant, and resin, or polymer is accomplished at a temperature of about 85° C. to about 105° C. for a duration of from about 1 hour to about 5 hours.

23. A process in accordance with claim 1 wherein a monomer is selected to enable a latex polymer and which monomer is selected from the group consisting of poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(aryl methacrylate-alkyl acrylate-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein said polymer is optionally present in an effective amount of from 80 percent by weight to about 98 percent by weight of toner.

24. A process in accordance with claim 12 wherein the toner particles isolated are from about 2 to about 10 microns in average volume diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner particles.

25. A process in accordance with claim 12 wherein there is selected for said latex preparation a cobalt complex catalytic chain transfer agent.

26. A process in accordance with claim 1 wherein said polymerization is accomplished in the presence of a non-ionic surfactant.

27. A process in accordance with claim 1 wherein heating is selected to accomplish the polymerization of said monomer and wherein said heating is at a temperature of from about 25 to about 120 degrees Centigrade.

* * * * *